US009431171B2

(12) United States Patent
Kusawake et al.

(10) Patent No.: US 9,431,171 B2
(45) Date of Patent: Aug. 30, 2016

(54) METHOD FOR MOLDING POWDER MOLD PRODUCT

(71) Applicants: SUMITOMO ELECTRIC INDUSTRIES, LTD., Osaka (JP); SUMITOMO ELECTRIC SINTERED ALLOY, LTD., Okayama (JP); SUMITOMO WIRING SYSTEMS, LTD., Mie (JP); AUTONETWORKS TECHNOLOGIES, LTD., Mie (JP)

(72) Inventors: Kazushi Kusawake, Itami (JP); Atsushi Sato, Itami (JP); Masato Uozumi, Itami (JP); Koji Yamaguchi, Osaka (JP)

(73) Assignees: Sumitomo Electric Industries, Ltd., Osaka-shi (JP); Sumitomo Electric Sintered Alloy, Ltd., Takahashi-shi (JP)

( * ) Notice: Subject to any disclaimer, the term of this patent is extended or adjusted under 35 U.S.C. 154(b) by 54 days.

(21) Appl. No.: 14/350,791

(22) PCT Filed: Oct. 5, 2012

(86) PCT No.: PCT/JP2012/076015

§ 371 (c)(1),
(2) Date: Apr. 9, 2014

(87) PCT Pub. No.: WO2013/054769

PCT Pub. Date: Apr. 18, 2013

(65) Prior Publication Data

US 2014/0232034 A1 Aug. 21, 2014

(30) Foreign Application Priority Data

Oct. 14, 2011 (JP) ..... 2011-227084

(51) Int. Cl.
*H01F 1/24* (2006.01)
*B30B 15/00* (2006.01)
(Continued)

(52) U.S. Cl.
CPC ..... *H01F 41/00* (2013.01); *B22F 3/02* (2013.01); *B30B 15/0011* (2013.01); *H01F 1/24* (2013.01); *H01F 41/0246* (2013.01); *B22F 3/03* (2013.01); *B22F 2003/026* (2013.01); *H01F 1/33* (2013.01)

(58) Field of Classification Search
None
See application file for complete search history.

(56) References Cited

U.S. PATENT DOCUMENTS 3,676,030 A * 7/1972 Roepenack ..... B22F 3/02 425/345
5,085,828 A * 2/1992 Shain ..... B22F 3/02 419/10

(Continued)

FOREIGN PATENT DOCUMENTS

CN 1066744 A 12/1992
CN 1253071 A 5/2000

(Continued)

OTHER PUBLICATIONS

International Search Report in PCT International Application No. PCT/JP2012/076015, dated Oct. 30, 2012.

(Continued)

*Primary Examiner* — Mary F Theisen
(74) *Attorney, Agent, or Firm* — Venable LLP; Michael A. Sartori; Trent B. Ostler

(57) ABSTRACT

The present invention relates to a method for molding a powder mold product according to which a powder mold product of uniform quality can be molded with excellent productivity. The present invention includes the steps of: preparing raw material powder 3 (a preparing step); interposing a mold assembly-use lubricant between an outer circumferential face 12*s* of a first punch (a lower punch 12) and an inner circumferential face 10*s* of a die 10, the lower punch 12 and the die 10 in this state being relatively shifted to apply the mold assembly-use lubricant to the inner circumferential face 10*s* of the die 10 (an applying step); and packing the raw material powder 3 into a cavity, a powder mold product 100 being molded by the raw material powder 3 being pressed (a molding step). In the applying step, while the mold assembly-use lubricant is discharged from a supply port 12*i* provided to the lower punch 12 and the discharged mold assembly-use lubricant is collected from a drain port 12*o* provided to the lower punch 12, the mold assembly-use lubricant is applied to the inner circumferential face 10*s* of the die 10.

7 Claims, 3 Drawing Sheets

(51) Int. Cl.

| | |
|---|---|
| ***H01F 41/00*** | (2006.01) |
| ***B22F 3/02*** | (2006.01) |
| ***H01F 41/02*** | (2006.01) |
| *B22F 3/03* | (2006.01) |
| *H01F 1/33* | (2006.01) |

(56) References Cited

U.S. PATENT DOCUMENTS

| | | | | |
|---|---|---|---|---|
| 5,093,076 | A * | 3/1992 | Young | B22F 3/02 148/101 |
| 6,436,166 | B2 | 8/2002 | Arvidsson et al. | |
| 6,482,349 | B1 | 11/2002 | Kohara et al. | |
| 7,544,417 | B2 | 6/2009 | Maeda et al. | |
| 2001/0038802 | A1* | 11/2001 | Ozaki | B22F 1/0059 419/36 |
| 2008/0152897 | A1 | 6/2008 | Maeda et al. | |

FOREIGN PATENT DOCUMENTS

| | | | |
|---|---|---|---|
| CN | 1373696 | A | 10/2002 |
| CN | 1660517 | A | 8/2005 |
| CN | 101107681 | A | 1/2008 |
| JP | 37-21508 | Y | 8/1962 |
| JP | 02-298202 | A | 12/1990 |
| JP | 03-291307 | A | 12/1991 |
| JP | 09-272901 | A | 10/1997 |
| JP | 09-279206 | A | 10/1997 |
| JP | 2000-197997 | A | 7/2000 |
| JP | 2002-363616 | A | 12/2002 |
| JP | 2003-025099 | A | 1/2003 |
| JP | 2006-202956 | A | 8/2006 |
| WO | WO-2006/077957 | A1 | 7/2006 |

OTHER PUBLICATIONS

Notification of the First Office Action in Chinese Patent Application No. 201280050576.8, dated Nov. 13, 2015.

Notification of the Second Office Action in Chinese Patent Application No. 201280050576.8, dated Jun. 1, 2016.

* cited by examiner

METHOD FOR MOLDING POWDER MOLD PRODUCT

TECHNICAL FIELD

The present invention relates to a method for molding a powder mold product by pressing raw material powder. In particular, the present invention relates to a method for molding a powder mold product that serves as a material of a magnetic core of a reactor, a motor and the like.

BACKGROUND ART

A magnetic component that includes: a magnetic core made of a soft magnetic material such as iron, iron alloy, or oxide such as ferrite; and a coil disposed on the magnetic core, is used in various fields. Specific examples may be an in-vehicle component that is mounted on a vehicle such as a hybrid vehicle or an electric vehicle, a motor, a transformer, a reactor, a choke coil and the like that are used as power supply circuit components of various electric devices. The magnetic core includes a lamination product made up of a plurality of thin electromagnetic steel sheets being stacked, and a powder magnetic core. The powder magnetic core is obtained by packing powder of the soft magnetic material noted above (hereinafter referred to as the soft magnetic powder) into a mold assembly to be molded, and subjecting the obtained powder mold product to heat treatment for removing strain.

In the case where the magnetic component is used in the alternating magnetic field, energy loss that is referred to as iron loss (approximately the sum of hysteresis loss and eddy-current loss) occurs at the magnetic core. The eddy-current loss is proportional to the square of the operating frequency. Accordingly, when the magnetic component is used at high frequencies of several kHz or more, the iron loss becomes significant. In such a case where the operating frequency is high, use of coated particles in which an insulating layer is provided to the outer circumference of each of soft magnetic metal particles made of iron or iron alloy (for example, see Patent Literature 1) can effectively reduce the eddy-current loss, and consequently, the iron loss.

In manufacturing the powder mold product, for example as disclosed in Patent Literature 1, a lubricant is applied to a mold assembly by spraying or with a brush. Thus, friction between the mold assembly and the powder mold product is reduced, whereby powder moldability is enhanced. In the case where the powder mold product is molded using soft magnetic powder made of coated particles, use of a lubricant in this manner can prevent the insulating layer from being damaged by sliding contact between the coated particles and the mold assembly or among the particles. Thus, a powder mold product having an excellent insulating characteristic can be obtained. Use of the powder mold product with such an excellent insulating characteristic can reduce the eddy-current loss, and eventually iron loss, of the powder magnetic core.

CITATION LIST

Patent Literature

Patent Literature 1: Japanese Unexamined Patent Publication No. 2006-202956

Patent Literature 2: Japanese Unexamined Patent Publication No. 09-272901

SUMMARY OF INVENTION

Technical Problem

However, with the conventional molding method, it is difficult to mold a product, which is not limited to the above-described powder magnetic core but including a powder mold product that is molded by raw material powder being pressed, of uniform quality highly productively.

By spraying or with a brush as described above, it is difficult to uniformly apply a lubricant to the face of the mold assembly with which the powder mold product may be brought into sliding contact. As the application area becomes greater, it becomes more difficult to achieve uniform application. Furthermore, during successive fabrication of a plurality of powder mold products, the applied state of the lubricant for fabricating the powder mold products tends to vary.

Accordingly, an object of the present invention is to provide a method for molding a powder mold product according to which a powder mold product of uniform quality can be molded highly productively.

Solution to Problem

As means for applying a lubricant uniformly and by a small thickness to the face of a mold assembly that may be brought into sliding contact with a mold product (hereinafter referred to as the sliding contact face), instead of independent application means such as spraying, the inventors of the present invention have considered provision of a supply port for a mold assembly-use lubricant to the mold assembly, such that the mold assembly itself could be used as means for applying the lubricant. As a result, the inventors of the present invention have found that, when a mold assembly including a pair of punches and one die is used, through use of relative shifting of at least one punch and the die, a lubricant can be uniformly applied to the inner circumferential face of the die that forms a cavity.

Further, the inventors of the present invention have considered application of a lubricant employing the relative shifting of the punch and the die, envisaging that powder mold products are successively molded with excellent productivity by repeating supply of power and molding. As a result, it was found that, when successive molding is performed using raw material powder, the supply port for the mold assembly-use lubricant may be clogged by accumulation of fine raw material powder having passed through the clearance between the die and the punch. In such a case, stable supply and application of the lubricant may be hindered.

Based on the foregoing findings, the inventors of the present invention have arrived at the method for molding a powder mold product of the present invention. In the following, the method for molding a powder mold product of the present invention will be stipulated.

The method for molding a powder mold product of the present invention is a powder mold product molding method in which raw material powder is packed into a cavity formed by a first punch and a die capable of being relatively shifted, and a powder mold product is molded by the raw material powder in the cavity being pressed by the first punch and a second punch. The molding method of the present invention includes the following preparing step, applying step, and molding step.

[Preparing Step]: A step of preparing raw material powder.

[Applying Step]: A step of interposing a mold assembly-use lubricant between the outer circumferential face of the first punch and the inner circumferential face of the die, the first punch and the die in this state being relatively shifted to apply the mold assembly-use lubricant to the inner circumferential face of the die.

[Molding Step]: A step of packing the raw material powder into the cavity surrounded by the first punch and the die to which the mold assembly-use lubricant has been applied, a powder mold product being molded by the raw material powder being pressed by the first punch and the second punch.

Here, in the applying step, while the mold assembly-use lubricant is discharged from a supply port provided to one of the die and the first punch and the discharged mold assembly-use lubricant is collected from a drain port provided to one of the die and the first punch, the mold assembly-use lubricant is applied to the inner circumferential face of the die. Note that the mold assembly-use lubricant may be discharged continuously or intermittently.

Though the molding method of the present invention can be used for molding any powder mold product, it is particularly suitable for fabricating a powder magnetic core (a powder mold product) used as a material of a magnetic core of a reactor, a motor and the like. For example, when raw material powder that contains coated soft magnetic powder being an aggregate of soft magnetic metal particles each provided with an insulating layer is employed as the raw material powder prepared in the preparing step in the molding method of the present invention, a powder magnetic core (a powder mold product) with an excellent magnetic characteristic can be molded.

In the molding method of the present invention, the constituents of the mold assembly, i.e., the first punch and the die, are employed as application means, and the applying work is performed using the relative shifting of the first punch and the die. Therefore, it is not necessary to separately prepare application means such as a spraying device and to dispose the same near the mold assembly. Further, with this structure, the operation for molding and the operation for application substantially overlap with each other. Accordingly, the working efficiency during molding is excellent, and excellent manufacturability of the powder mold product is exhibited.

Further, in the molding method of the present invention, while the mold assembly-use lubricant is supplied between the outer circumferential face of the first punch and the inner circumferential face of the die from the supply port, the surplus of the mold assembly-use lubricant is drained from the drain port (hereinafter this scheme may be referred to also as circulative supply). Accordingly, excessive supply and application of the mold assembly-use lubricant can be prevented. Furthermore, execution of the circulative supply achieves collection of fine raw material powder having passed through the clearance between the die and the punch, as well as drainage of the surplus of the mold assembly-use lubricant. Thus, such powder is prevented from accumulating in the mold assembly or clogging the supply port. Thanks to these points, even when the number of successively molded powder mold products is increased, powder mold products of uniform quality can be molded highly productively. In particular, in the case where a powder magnetic core is fabricated using raw material powder containing coated soft magnetic powder, the insulating layer of the soft magnetic powder is not easily damaged by the surplus of the mold assembly-use lubricant. Thus, a powder mold product with small iron loss can be molded highly productively.

Herein, the disposition of the supply port and the drain port in the mold assembly for achieving the circulative supply may be any of the following (1) to (3). That is, (1) both the supply port and the drain port are provided to the outer circumferential face of the first punch, (2) both the supply port and the drain port are provided to the inner circumferential face of the die, and (3) one of the supply port and the drain port is provided to the inner circumferential face of the die and the other one is provided to the outer circumferential face of the first punch. Of these structures, with the structures (2) and (3) (in which at least one of the supply port and the drain port is provided to the inner circumferential face of the die), it is preferable to provide a reservoir groove for temporarily storing the mold assembly-use lubricant at the outer circumferential face of the first punch. The width, length and depth of the reservoir groove are not particularly limited.

Further, in order to achieve smooth circulative supply, a distributing groove that is connected to the supply port for distributing the mold assembly-use lubricant discharged from the supply port may be provided. Alternatively, a collecting groove that is connected to the drain port for collecting and guiding the surplus of the mold assembly-use lubricant to the drain port may be provided. In the case where both the supply port and the drain port are provided to one of the die and the first punch, it is preferable to connect the distributing groove and the collecting groove to each other. That is, it is preferable to form one circulative groove that extends from the supply port to the drain port. The width, length, and depth of the distributing groove, the collecting groove, and the circulative groove are not particularly limited.

As one mode of the molding method of the present invention, in the applying step, the mold assembly-use lubricant may be applied over the entire inner circumferential face of the die.

With the structure described above, the powder mold product can be released from the mold assembly with ease. Further, with the structure described above, in the case where a powder magnetic core (a powder mold product) is fabricated using raw material powder containing coated soft magnetic powder, in the outer circumferential face of the powder mold product, the insulating layer at the face opposing to the sliding contact face of the die can be effectively prevented from being damaged. As a result, a powder mold product with small iron loss can be fabricated.

In the case where the mold assembly-use lubricant is applied to the entire inner circumferential face of the die, for example, as shown in FIGS. 1 and 2 of a first embodiment which will be described later, a supply port 12*i* and a drain port 12*o* for the mold assembly-use lubricant may be disposed so as to be displaced from each other in both the horizontal direction and the vertical direction of the first punch (a lower punch 12), and the supply port 12*i* and the drain port 12*o* may be further connected to each other by a circulative groove 12*g*. In this case, the circulative groove 12*g* should have a length greater than one turn over the outer circumferential of the lower punch 12.

As one mode of the molding method of the present invention, the mold assembly-use lubricant may be applied to part of the inner circumferential face of the die.

In the case where the mold assembly-use lubricant is applied to part of the inner circumferential face of the die, the mold assembly-use lubricant is applied so as to divide the inner circumferential face of the die in the circumferential direction. That is, the mold assembly-use lubricant is applied so as to be substantially parallel to the pressing direction. In particular, in the case where a powder magnetic core (a powder mold product) is fabricated using raw material powder containing coated soft magnetic powder, when the mold assembly-use lubricant is applied so as to divide the inner circumferential face of the die in the circumferential direction, a region having a sound insulating layer extending substantially in parallel to the pressing direction of the outer circumferential face of the powder mold product can be formed. In the case where such a powder mold product is excited as a magnetic core, when the pressing direction and the magnetic flux direction are identical to each other, in the outer circumferential face of the powder mold product, an eddy current that flows in the circumferential direction about the magnetic flux direction can be divided. As a result, iron loss of the powder mold product can be reduced.

In the case where the mold assembly-use lubricant is applied to the inner circumferential face of the die so as to divide the inner circumferential face of the die in the circumferential direction, for example, as shown in FIGS. 3(A) to (C) of a second embodiment, a supply port 12*i* and a drain port 12*o* may be disposed so as to be displaced from each other in one of the circumferential direction and the axial direction of the lower punches 12A to 12C, and may be connected to each other by a circulative groove 12*g*.

As one mode of the molding method of the present invention, in the preparing step, the raw material powder being mixed with a raw material-use lubricant made of a solid lubricant may be prepared.

Since the mold assembly-use lubricant is applied to the mold assembly and the raw material-use lubricant is mixed with the raw material powder such that the raw material powder itself is provided with lubricity, it becomes possible to reduce friction between the particles forming the raw material powder and the mold assembly and friction among the particles during molding of the powder mold product. In particular, in the case where a powder magnetic core (a powder mold product) is fabricated using raw material powder containing coated soft magnetic powder, by reducing friction among the particles, the insulating layer can be effectively prevented from being damaged not only at the sliding contact face of the powder mold product but also at the inside of the powder mold product. Thus, a powder magnetic core with small iron loss can be obtained.

As one mode of the molding method of the present invention, the mold assembly-use lubricant that is applied to the inner circumferential face of the die may be a dispersed agent in which particles made of a solid lubricant are dispersed in a non-flammable liquid medium.

Since the dispersed agent is used as the mold assembly-use lubricant, as compared to the case where solely the solid lubricant is used or solely the liquid lubricant is used, the lubricant can be uniformly applied to the inner circumferential face of the die with ease, and this uniform application state can be maintained with ease. For example, in the case where solely the solid lubricant powder is used as the mold assembly-use lubricant, the supply port or the drain port of the lubricant may be clogged. Further, since it is poor in flowability than the dispersed agent, it may not easily be attached to the inner circumferential face of the die. Even when it is applied, it may be fallen off by the gravity. On the other hand, in the case where a liquid lubricant is used as the mold assembly-use lubricant, for example, with a liquid lubricant with high viscosity such as grease, similarly to the above-described case where solely a solid lubricant is used, the supply port or the drain port may be clogged, or the lubricant may become excessive or insufficient (uneven application) because of poor flowability. In the molding method of the present invention in which the dispersed agent is used, the liquid medium serves as the aid agent for enhancing the flowability of particles made of a solid lubricant. Thus, as described above, ease of applying work and uniform presence of the mold assembly-use lubricant at the inner circumferential face of the die can be facilitated. In particular, in the molding method of the present invention, safety of the operator can be enhanced by employing a non-flammable liquid medium.

As one mode of the present invention, the solid lubricant in the mold assembly-use lubricant may include ethylene bis stearamide.

Ethylene bis stearamide exhibits excellent lubricity. In particular, in the case where raw material powder containing coated soft magnetic powder is used, thanks to the excellent lubricity, the insulating layer of each of the particles forming the powder can be effectively prevented from being damaged. Further, since ethylene bis stearamide does not contain any metal element, in the case where the powder mold product obtained in the foregoing mode is subjected to heat treatment, oxide containing a metal element is not formed during the heat treatment. Hence, contamination of the heat treating furnace attributed to generation of such oxide is not likely to occur.

Advantageous Effects of Invention

According to the method for molding a powder mold product of the present invention, powder mold products of uniform quality can be successively molded highly productively.

DESCRIPTION OF EMBODIMENTS

First Embodiment

In the following, with reference to the drawings, a detailed description will be given of an exemplary manner of molding a powder magnetic core according to a method for molding a powder mold product of the present invention. In the description, firstly, a description will be given of a mold assembly used in the method for molding a powder mold product of the present invention. Subsequently, a description will be given of a mold assembly-use lubricant and raw material powder. Finally, a description will be given of the molding method. Note that, the method for molding a powder mold product of the present invention is not limited to molding of a powder magnetic core, and can be used for molding a non-magnetic powder mold product.

[Mold Assembly]

Figure 1:
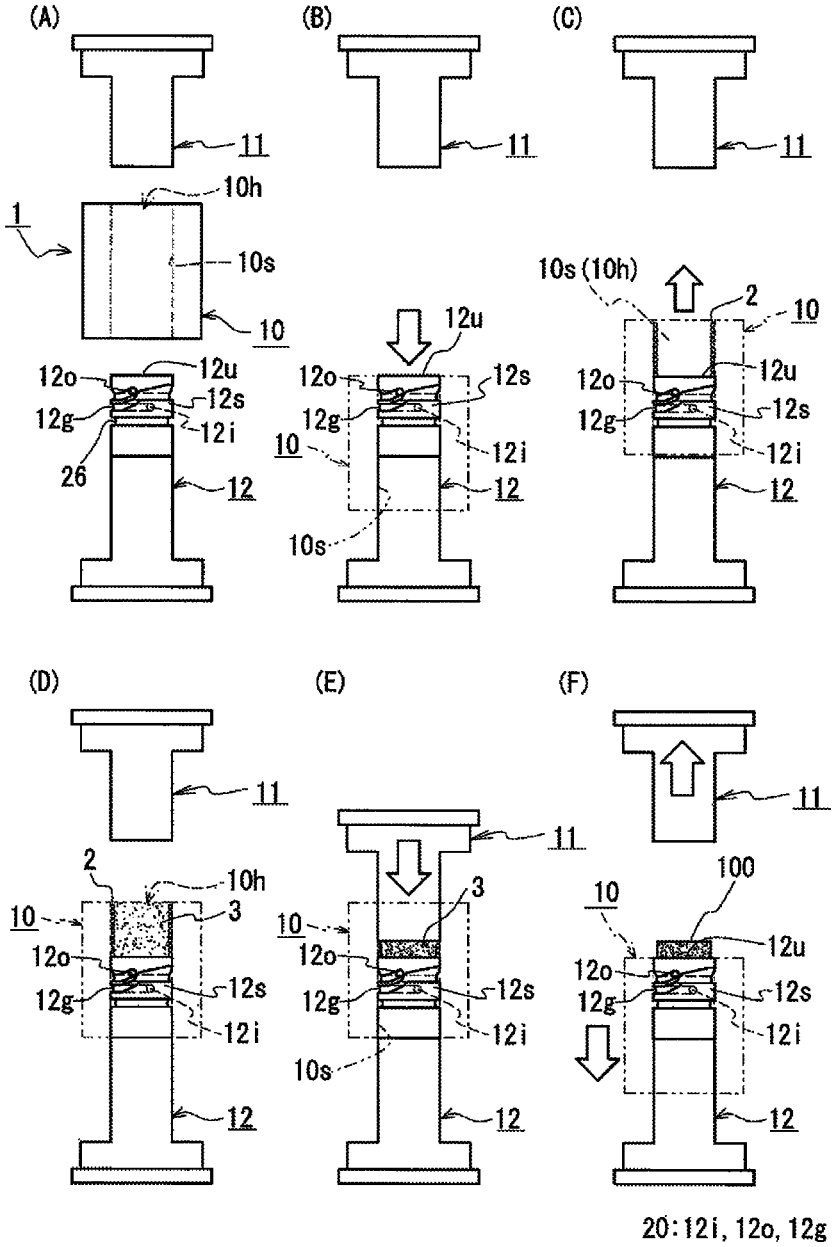
FIGS. 1(A) to 1(F) are each a step explanatory diagram for describing a procedure of a method for molding a powder mold product of the present invention.
Figure 2:
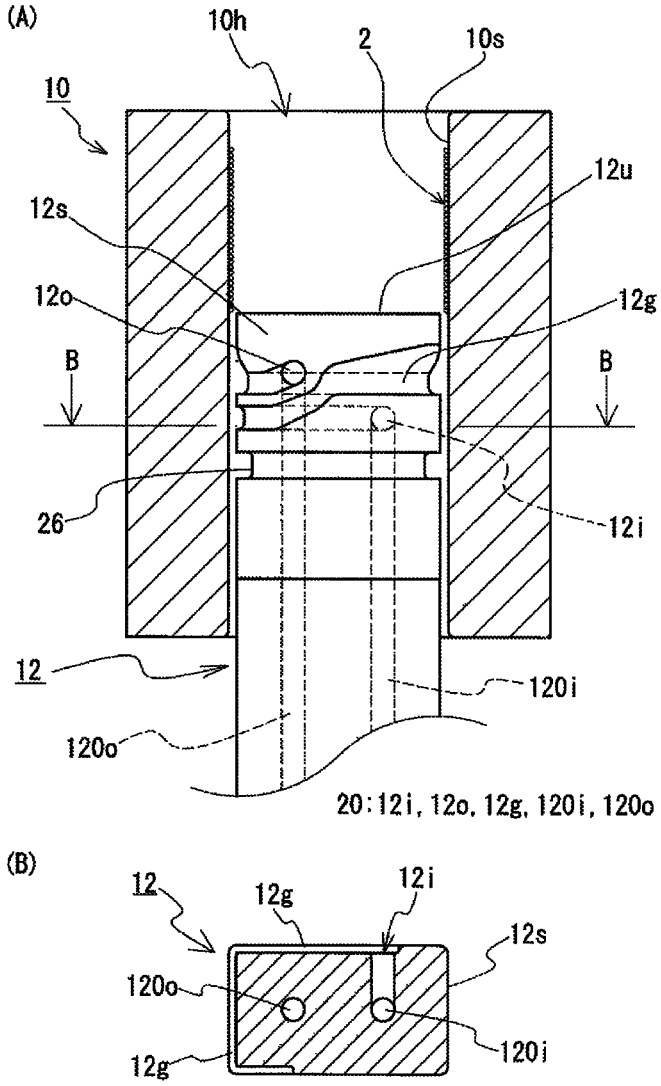
FIG. 2(A) is a partial enlarged cross sectional view showing a lower punch and a die of a mold assembly that is used in the method for molding a powder mold product of the present invention according to the first embodiment.
FIG. 2(B) is a cross sectional view taken along line B-B in FIG. 2(A).

As a mold assembly to be used, for example, as shown in FIGS. 1 and 2, a mold assembly 1 that includes: a tubular die 10 having a quadrangular through hole 10*h*; and a pair of prism-shaped upper punch 11 and lower punch 12 removably inserted into the through hole 10*h* (see the horizontal cross-sectional view of FIG. 2(B)). Note that, the cross section of the upper and lower punches 11 and 12 are not limited to be prism-shaped, and any columnar shape will suffice. That is, the shape of the through hole 10*h* and the horizontal cross-sectional shape of the punches 11 and 12 are not limited to be quadrangular. For example, it may be an ellipse including a circle, any polygon except for a quadrangle, or an odd shape such as a sector formed by a combination of straight lines and arcs.

In the mold assembly 1 shown in FIG. 1, the lower punch 12 is fixed to a not-shown body apparatus, and the die 10 and the upper punch 11 are capable of being individually shifted in the top-bottom direction by a not-shown shifting mechanism. It goes without saying that the die 10 may be fixed while the punches 11 and 12 are shiftable. It is also possible that both the die 10 and the punches 11 and 12 are shiftable. The constituent material of the mold assembly 1 may include any appropriate high-strength material (e.g., high-speed steel) that is conventionally used for molding a powder mold product made of any metal.

(Circulative Supply Mechanism)

The mold assembly 1 of the present embodiment includes a circulative supply mechanism 20 for a mold assembly-use lubricant. While the circulative supply mechanism 20 is discharging a mold assembly-use lubricant into a clearance between an outer circumferential face 12*s* of the lower punch 12 and an inner circumferential face 10*s* of the die 10 and collecting the surplus of the discharged mold assembly-use lubricant, the circulative supply mechanism 20 applies the mold assembly-use lubricant over the entire circumference of the inner circumferential face 10*s* of the die 10. The circulative supply mechanism 20 according to the present embodiment is provided to the lower punch 12 as shown in FIG. 2, and includes a supply port 12*i*, a supply flow passage 120*i*, a drain port 12*o*, a drain flow passage 120*o*, and a circulative groove 12*g*.

The supply port 12*i* is opened at the face on the depth side in FIG. 2(A) (the face on the top side in FIG. 2(B)), out of the four faces structuring the outer circumferential face 12*s* of the lower punch 12 formed to be prism-shaped. The supply port 12*i* is a hole that is supplied with the mold assembly-use lubricant from the supply flow passage 120*i* communicating with the supply port 12*i*, and that discharges the lubricant to the outer circumferential face 12*s* of the lower punch 12.

The supply flow passage 120*i* communicating with the supply port 12*i* is a pipe passage that extends from the rear end side to the leading end side of the lower punch 12 along the axial direction of the lower punch 12 (the top-bottom direction in FIG. 2(A); the depth direction in FIG. 2(B)), and that bends along the way to extend toward the outer circumferential face 12*s* of the lower punch 12 (the face on the depth side in FIG. 2(A); the face on the top side in FIG. 2(B)). Thus, since most part of the supply flow passage 120*i* is provided on the center side of the lower punch 12, a reduction in the strength of the lower punch 12 attributed to the supply flow passage 120*i* can be suppressed. Note that, on the bottom end side of the supply flow passage 120*i*, a tank that stores the mold assembly-use lubricant and a pump that sends the mold assembly-use lubricant in the tank to the supply flow passage 120*i* are provided (both not shown).

On the other hand, the drain port 12*o* collecting the surplus of the mold assembly-use lubricant is opened at the face on the near side in FIG. 2(A) (the face on the bottom side in FIG. 2(B)), out of the four faces of the lower punch 12. Further, the drain port 12*o* is located nearer to the leading end side (the top face 12*u* side) of the lower punch 12 than the supply port 12*i* is, in the axial direction of the lower punch 12. That is, the drain port 12*o* and the supply port 12*i* are disposed so as to be displaced from each other in both the circumferential and axial directions of the lower punch 12.

The drain port 12*o* communicates with the drain flow passage 120*o*. Similarly to the supply flow passage 120*i*, the drain flow passage 120*o* is also a pipe passage that extends from the rear end side to the leading end side of the lower punch 12 along the axial direction of the lower punch 12 (the top-bottom direction in FIG. 2(A); the depth direction in FIG. 2(B)), and that bends along the way to extend toward the outer circumferential face 12*s* of the lower punch 12 (the face on the near side in FIG. 2(A); the face on the bottom side in FIG. 2(B)). The leading end portion of the bent drain flow passage 120*o* is connected to the drain port 12*o*.

To the bottom end side of the drain flow passage 120*o*, a collecting-purpose tank that stores collected mold assembly-use lubricant is provided (not shown). The mold assembly-use lubricant collected and stored in the tank should be subjected to any appropriate treatment to be recycled. In other possible mode, the drain flow passage 120*o* may be directly coupled to the supply-purpose tank. However, in such a case, it is preferable to provide an agitation mechanism or the like in the tank, such that the mold assembly-use lubricant to be supplied attains uniform quality. In the above-described mode in which the mold assembly-use lubricant is recycled, fine raw material powder contained in the collected mold assembly-use lubricant is separated in order to prevent such raw material powder from re-entering the circulation system. In separating the fine powder, any of a magnet or a filter may be used.

Though the opening shape of each of the supply port 12*i* and the drain port 12*o* is not particularly limited, it is preferably a circle. This allows the mold assembly-use lubricant to be smoothly supplied or drained. Similarly, though the cross-sectional shape of each of the supply flow passage 120*i* and the drain flow passage 120*o* is not particularly limited, it is preferably a circle.

Further, the diameter of each of the supply port 12*i* and the drain port 12*o* (the diameter of each of the supply flow passage 120*i* and the drain flow passage 120*o*) can be selected as appropriate depending on the material or form of the mold assembly-use lubricant, which will be described later. However, there is a preferable relative relationship between their respective diameters. Specifically, it is preferable that the diameter of the drain port 12*o* is 1 to 2 times as great as the diameter of the supply port 12*i*. By setting the drain port 12*o* to be greater, the mold assembly-use lubricant that is circulative supplied can be smoothly collected.

Next, a description will be given of the circulative groove 12*g*. The circulative groove 12*g* is a spiral groove that circles around the outer circumferential face 12*s* of the lower punch 12 by about one and a half turns, and is provided to connect between the supply port 12*i* and the drain port 12*o*. Provision of the circulative groove 12*g* makes it possible to smoothly guide a surplus of the mold assembly-use lubricant, which has been discharged from the supply port 12*i*, to the drain port 12*o*.

The cross-sectional shape of the circulative groove 12*g* can be selected as appropriate. For example, the cross-sectional shape may be a circle, a quadrangle, a trapezoid or the like. Here, when the diameter of the drain port 12*o* is set to be greater than that of the supply port 12*i* as described above, the width of the circulative groove 12*g* also should be varied in accordance with the diameter of the supply port 12*i* and the drain port 12*o*. For example, the width of the circulative groove 12*g* should be gradually increased from the supply port 12*i* toward the drain port 12*o*.

In addition to the circulative supply mechanism 20 described above, the mold assembly 1 according to the present embodiment includes a sealing groove 26 in a region on the rear end side than the supply port 12*i* on the outer circumferential face 12*s* of the lower punch 12. The sealing groove 26 is an annular groove that circles around the outer circumferential face 12*s* of the lower punch 12, and prevents the mold assembly-use lubricant discharged from the supply port 12*i* from leaking to any position at the rear end side relative to the sealing groove 26. When a porous element such as a sponge with high sealability is disposed in the sealing groove 26, such leakage can be more effectively prevented. In addition, the lubricant absorbed by the porous element allows the die 10 to be shifted smoothly. The cross-sectional shape, shape of front view, size (capacity) of the sealing groove 26, and the formation region in the circumferential direction of the lower punch can be selected as appropriate.

Note that, depending on the supplied amount of the mold assembly-use lubricant or the like, in some cases, the mold assembly-use lubricant is less likely to leak toward the rear end side of the lower punch 12. In such cases, the sealing groove 26 can be dispensed with. Further, the porous element may not be disposed in the sealing groove 26, and the leaked mold assembly-use lubricant may be accumulated as it is therein.

(Dimension Relationship of Members of Mold Assembly)

The dimension of the lower punch 12 and the die 10 is set such that a clearance in which the die 10 is shiftable is formed between the outer circumferential face 12*s* of the lower punch 12 and the inner circumferential face 10*s* of the die 10 (the clearance is exaggerated in FIG. 2).

Here, in the present embodiment, the dimension of the through hole 10*h* of the die 10 is set to be uniform along the axial direction of the through hole 10*h*, and the outer shape of the lower punch 12 is oddly shaped such that the dimension of the clearance is partially varied. Specifically, the outer dimension of the region on the leading end side (the top face 12*u* side) relative to the circulative groove 12*g* is set to be smaller than the outer dimension of the region on the rear end side relative to the circulative groove 12*g*. That is, the clearance on the leading end side relative to the circulative groove 12*g* is set to be greater than the clearance on the rear end side. Thus, by the relative shifting of the lower punch 12 and the die 10, the discharged mold assembly-use lubricant in the circulative groove 12*g* can be evenly applied to the inner circumferential face 10*s* of the die 10. Further, the mold assembly-use lubricant does not easily leak toward the rear end side than the circulative groove 12*g*.

[Mold Assembly-Use Lubricant]

Next, a description will be given of the mold assembly-use lubricant that is applied to the mold assembly. The mold assembly-use lubricant may be a liquid lubricant, a solid lubricant, or a liquid medium (which may function as a lubricant or may not substantially function as a lubricant) in which a solid lubricant is dispersed. In particular, it is preferable to use, as the mold assembly-use lubricant, a dispersed agent in which particles made of a solid lubricant are dispersed in a non-flammable liquid medium.

(Solid Lubricant)

As the solid lubricant, a variety of materials can be used. For example, the solid lubricant may be: a substance containing a metal element, representatively a metallic soap such as lithium stearate, zinc stearate or the like; and a substance not containing a metal element, representatively fatty acid amide such as stearic acid, laurylamide, stearamide, palmitic acid amide or the like, and higher fatty acid amide such as ethylene bis stearamide. One or more types of solid lubricant selected from the materials noted above can be used. A single type of lubricant or a combination of a plurality of different materials of solid lubricants may be used. In particular, ethylene bis stearamide exhibits excellent lubricity, and can prevent the insulating layer of the coated soft magnetic powder from being damaged by friction with the mold assembly. As will be described later, in the case where a mold assembly-use lubricant is applied and thereafter heated, so as to vaporize and thus remove the liquid medium, it is preferable to employ a solid lubricant that does not easily alter by such heat.

The size of each particle in the solid lubricant is preferably smaller than the clearance between the die 10 and the lower punch 12. Thus, it becomes possible to effectively prevent the mold assembly-use lubricant applied to the inner circumferential face 10*s* of the die 10 to be removed by the shifting operation of the die 10, which will be described later. Thus, the state where the solid lubricant is applied can be maintained in an excellent manner. The specific maximum particle size of each particle forming the solid lubricant is preferably 20 μm or less, and further preferably 10 μm or less. In particular, with fine particles each measuring 5 μm or less, it is expected that a further reduction in the coating thickness is achieved. Furthermore, flowability of the mold assembly-use lubricant can be enhanced, whereby further uniform application of the mold assembly-use lubricant can be facilitated.

(Liquid Medium)

The liquid medium is mainly used as a medium for enhancing flowability of solid lubricant powder in the mold assembly-use lubricant. In particular, in the molding method of the present invention, the liquid medium is preferably non-flammable in order to ensure safety of the operator. The non-flammable liquid medium may be, representatively, a liquid with no flash point. Simply put, the non-flammable liquid medium may be any liquid other than hazardous materials. The non-flammable liquid medium may be an inorganic substance or an organic substance, so long as it is a non-flammable liquid medium.

The inorganic substance may be water. Water is advantageous in that it can be prepared with ease, being safe and putting small environment load. In the case where a liquid medium that does not substantially function as a lubricant, such as water, is used, it is desired that the mold assembly-use lubricant is removed after being applied to the inner circumferential face 10*s* of the die 10. For example, the removal may be performed by heating of the lower punch 12. However, heating of the die 10 with the applied liquid medium can remove the liquid medium quickly and easily, and hence excellent workability is exhibited. The heating temperature is preferably 50° C. or more. The higher the heating temperature, the shorter the time required for vaporization, i.e., the better the workability. Accordingly, the temperature of 60° C. or more is further preferable. On the other hand, the temperature of less than 100° C. can reduce the energy associated with the heating. The heating temperature is further preferably about 65° C. to 75° C. In order to heat the mold assembly 1 such as the die 10, heating means such as a cartridge heater may be built in the die 10, or hot air may be blown in the die 10.

In the case where powder mold products are successively molded, the mold assembly 1 may be heated to some extent by heat produced by operations of such successive molding. For example, when the temperature of the mold assembly has reached 50° C. or more by the heat produced by operations, it is not necessary to perform heating by any heating means for removing the liquid medium for each molding process. That is, the liquid medium may be vaporized and removed by solely the heat produced by operations. Use of the heat produced by operations can eliminate or reduce separate heating means or energy for vaporization and removal. By measuring the temperature of the mold assembly as appropriate, the necessity of heating by heating means can be determined in accordance with the measured temperature.

On the other hand, when an organic substance of high volatility is used as the aforementioned organic substance (a commercially available solvent, e.g., a solvent including 1-bromopropane whose alias name is n-propyl bromide (99 mass percent)), the liquid medium can be easily removed without the necessity of heating the mold assembly 1 (the die 10) as described above, or at reduced heating temperatures. Further, a substance with excellent lubricity, such as lubricating oil, can be used as the organic substance. In the case where a liquid medium with excellent lubricity is used, the liquid medium removing step by heating can be dispensed with. Further, in the molding method of the present invention, since the mold assembly-use lubricant contains a solid lubricant, even when a liquid lubricant is used for the liquid medium, it is expected that the liquid will not easily drip.

In the case where a dispersed agent in which a solid lubricant is dispersed in a liquid medium is used, though it depends on the material of the liquid medium and the solid lubricant, the concentration of the dispersed agent (the mass of the solid lubricant/the mass of the dispersed agent) should be approximately 10 to 50 mass percent. Further, as to the amount of the mold assembly-use lubricant applied to the inner circumferential face 10*s* of the die 10 (the mass of solid lubricant (the gross mass of the dispersed agent for a liquid medium with lubricity)/the area of the inner circumferential face 10*s*) also, though it depends on what substance is used as the liquid medium or the solid lubricant, the function as a lubricant can be sufficiently achieved by a concentration of approximately 0.001 to 0.1 g/cm$^2$.

[Raw Material Powder]

Next, a description will be given of raw material powder used in the molding method of the present invention. In the molding method of the present invention, raw material powder that contains coated soft magnetic powder being an aggregate of soft magnetic metal particles each provided with an insulating layer is prepared as raw material powder. It is also possible to provide the raw material powder itself with lubricity. Specific schemes of providing the raw material powder with lubricity may be as follows: a mode in which a material with lubricity is used as the insulating layer (the coat internal lubrication); a mode in which the coated soft magnetic powder is a powder mixture containing a solid lubricant (the raw material-use lubricant) by a particular amount (the mixture internal lubrication); and a composite mode of the coat internal lubrication and the mixture internal lubrication (the composite internal lubrication).

(Soft Magnetic Metal Particle)

The material of the soft magnetic metal particles preferably contains iron by 50 mass percent or more. For example, pure iron (Fe), or one type of iron alloy selected from Fe—Si based alloy, Fe—Al based alloy, Fe—N based alloy, Fe—Ni based alloy, Fe—C based alloy, Fe—B based alloy, Fe—Co based alloy, Fe—P based alloy, Fe—Ni—Co based alloy, and Fe—Al—Si based alloy. In particular, from the viewpoint of magnetic permeability and magnetic flux density, pure iron containing Fe by 99 mass percent or more is preferable.

It is preferable that the average particle size d of the soft magnetic metal particles is 1 μm or more and 70 μm or less. By the average particle size d being 1 μm or more, excellent flowability is exhibited. Furthermore, in the case where a magnetic core is fabricated with a powder mold product obtained by the molding method of the present invention, an increase in hysteresis loss can be suppressed. By the average particle size d being 70 μm or less, even in the case where a magnetic core is fabricated with the obtained powder mold product and used at high frequencies of 1 kHz or more, the eddy-current loss can be effectively reduced. In particular, when the average particle size d is 50 μm or more, the effect of a reduction in hysteresis loss can be easily achieved, and furthermore, the powder can be handled with ease. The average particle size d refers to the particle size with which the sum of mass of particles, when calculated from the smaller particles, reaches 50% of gross mass in the histogram of particle size. That is, 50% particle size (mass) is meant.

(Insulating Layer)

Since each soft magnetic metal particle has an insulating layer on its surface, the powder mold product obtained by the molding method of the present invention has an excellent insulating characteristic. Further, when the magnetic core is fabricated with the powder mold product, the soft magnetic metal particles can be insulated from each other by their respective insulating layers. By preventing the particles from being brought into contact with each other, a reduction in eddy-current loss can be achieved.

The thickness of the insulating layer may be 10 nm or more and 1 μm or less. When the thickness is 10 nm or more, insulation among the soft magnetic metal particles can be secured. When the thickness is 1 μm or less, the presence of the insulating layer can suppress a reduction in the proportion of the soft magnetic material in the powder mold product. That is, when the magnetic core is fabricated with the powder mold product, a significant reduction in magnetic flux density can be suppressed. The thickness of the insulating layer is an average thickness determined as follows. Based on a film composition obtained by composition analysis (with an analyzer using a transmission electron microscope and energy-dispersive X-ray spectroscopy: TEM-EDX) and the amount of elements obtained by an inductively coupled plasma mass spectrometer (ICP-MS), an equivalent thickness is derived. Further, the insulating layer is directly observed by a TEM micrograph, to check that the order of the previously derived equivalent thickness is a proper value.

The material of an insulating layer with no lubricity may include metal oxide, metal nitride, and metal carbide such as oxide, nitride, and carbide of one or more types of metal element selected from, for example, Fe, Al, Ca, Mn, Zn, Mg, V, Cr, Y, Ba, Sr, and rare earth elements (except for Y). Further, the insulating material may include a metal compound other than metal oxide, metal nitride, and metal carbide. For example, the insulating material may include one or more types of compound selected from a phosphorous compound, a silicon compound, a zirconium compound, and an aluminum compound. Other insulating material may include a metal salt compound, e.g., a metal phosphate compound (representatively, iron phosphate, manganese phosphate, zinc phosphate, calcium phosphate or the like), a metal borate compound, a metal silicon compound, a metal titanate compound and the like. Since metal phosphate compounds deform easily, when an insulating layer made of a metal phosphate compound is provided, the insulating layer deforms easily conforming to the deformation of the soft magnetic metal particles during molding of a powder mold product. Hence, the insulating layer is not easily damaged, and a powder mold product having an insulating layer in the sound state can be easily obtained. Further, an insulating layer made of a metal phosphate compound strongly attaches to iron based soft magnetic metal particles, and is not easily removed from the surface of the particles. For forming the insulating layer, for example, the phosphating process can be used. Alternatively, for forming the insulating layer, the solvent blowing process or the sol-gel process using precursors can be used.

Exemplary material of the insulating layer having lubricity may include, for example, resin such as thermoplastic resin or non-thermoplastic resin, and higher fatty acid salt. In particular, silicone resin and stearate increase lubricity of the raw material powder (coated soft magnetic powder) when the raw material powder is molded under pressure. Thus, dispersion of the coated soft magnetic powder and releasability of a mold product from the mold assembly can be improved. Further, since a silicone based organic compound such as silicone resin exhibits excellent heat resistance, the obtained powder mold product does not easily decomposed even when it is subjected to heat treatment. For forming the insulating layer made of a silicone based organic compound, wet coating process using an organic solvent or a direct coating process using a mixer can be employed.

In particular, in the case where an insulating layer made of silicone resin is included, an inner film made of an insulating material containing water of hydration may be formed on the surface of soft magnetic metal particles. Then, a silicone resin film may be formed on the inner film using a material that forms silicone resin by a hydrolysis condensation polymerization reaction using the inner film as the source of water molecules. In this case, the hydrolysis condensation polymerization reaction can occur very quickly and the silicone resin film can be efficiently formed. Thus, an insulating layer of a multilayer structure made up of the inner film and the silicone resin film can be formed with excellent productivity. Further, since the silicone resin film formed by a hydrolysis condensation polymerization reaction deforms easily as described above, the silicone resin film does not easily break or crack during molding, and hence the silicone resin film is not easily peeled off from the inner film. Further, since this silicone resin film exhibits excellent heat resistance, damage such as pyrolysis will not easily be done to the obtained powder mold product during heat treatment. Accordingly, the coated soft magnetic powder having an insulating layer of the multilayer structure has excellent insulating characteristic and heat resistance, and exhibits excellent deformability and adhesion.

The inner film containing water of hydration can be formed by employing aforementioned metal phosphate compound or the like that contains water of hydration. The resin material that forms silicone resin by a hydrolysis condensation polymerization reaction may be, for example, a compound expressed by: Sim(OR)n (m, n are each a natural number and OR is a hydrolyzable group). The hydrolyzable group may be, for example, alkoxy group, acetoxy group, halogen group, isocyanate group, hydroxyl group or the like. More specifically, alkoxy oligomer in which molecular end is terminated by alkoxysilyl group (═Si—OR) can be preferably used as the material. The alkoxy group may include, for example, methoxy, ethoxy, propoxy, isopropoxy, butoxy, sec-butoxy, and tert-butoxy. In particular, with methoxy, a reaction product after hydrolysis can be removed easily. Such resin materials can be used solely or in combination. The resin material that forms silicone resin by a hydrolysis condensation polymerization reaction may be a commercially available product, for example, TSR116 or XC96-B0446 available from GE Toshiba Silicones Co., Ltd.

The coated soft magnetic powder that has an insulating layer of a two-layer structure, i.e., made up of the inner film and the silicone resin film, can be manufactured as follows, for example. Soft magnetic metal powder is prepared. Then, an inner film is formed on the surface of the particles that form the powder by the phosphating process or the sol-gel process described above. Thereafter, the coated particles and a resin material that becomes silicone resin by a hydrolysis condensation polymerization reaction are mixed in the heating atmosphere (80° C. to 150° C., preferably 100° C. or more). Water of hydration contained in the constituent material of the inner film is separated by the mixing in the heating atmosphere. Thus, hydrolysis of the resin material is accelerated, and silicone resin can be formed. In performing the mixing, organic acid such as formic acid, maleic acid, fumaric acid, acetic acid and the like or inorganic acid such as hydrochloric acid, phosphoric acid, nitric acid, boric acid, sulfuric acid and the like can be used as catalyst.

(Raw Material-Use Lubricant)

In the case of the mixture internal lubrication (or the composite internal lubrication) in which the raw material powder is caused to contain a raw material-use lubricant, the raw material-use lubricant used here is preferably powder formed by particles of a solid lubricant. By employing powder instead of a liquid lubricant, the raw material-use lubricant can be easily mixed with the coated soft magnetic powder, and furthermore, powder mixture can be handled with ease. The material of the raw material-use lubricant may be of various types. The various types of metallic soap, various types of fatty acid amide, and various types of higher fatty acid amide noted above in connection with the mold assembly-use lubricant can be used. In other possible mode, an inorganic lubricant having the hexagonal crystal structure, e.g., an inorganic substance selected from boron nitride, molybdenum sulfide, tungsten sulfide, and graphite, may be used. Such an inorganic substance and the aforementioned metallic soap and the like may be used in combination. The material of the raw material-use lubricant and that of the mold assembly-use lubricant may be identical or different.

It is preferable to use a raw material-use lubricant that can be uniformly mixed with the coated soft magnetic powder with ease, that is sufficiently deformable among the soft magnetic metal particles during molding of the powder mold product, and that can be easily removed by heat of heat treatment to which the obtained powder mold product is subjected.

In the molding method of the present invention, as described above, the coat internal lubrication, the mixture internal lubrication, and the composite internal lubrication can be used. With the coat internal lubrication, the content proportion of the coated soft magnetic powder in the raw material powder can be increased. In the case where the magnetic core is fabricated with the obtained powder mold product, the magnetic characteristic of the magnetic core can be improved. On the other hand, with the mixture internal lubrication, the damage to the insulating layer of the raw material powder can be effectively suppressed. The content proportion of the raw material-use lubricant relative to the coated soft magnetic powder is 0.4 mass percent to 0.8 mass percent (the total amount when a plurality of materials are used). By setting the content of the raw material-use lubricant to fall within the specific range noted above, as shown in the following test examples, excellent lubricity is exhibited, and any damage to the insulating layer of the raw material powder can be effectively suppressed as compared to the case where the raw material powder has no lubricity and the lubricant is applied only to the mold assembly, or to the case where a lubricant is mixed with the raw material powder and no lubricant is applied to the mold assembly. As a result, in the obtained powder mold product also, many insulating layers in the sound state are present. In the case where a magnetic core is fabricated with the powder mold product, the magnetic core exhibits an excellent insulating characteristic. Further, by adopting the composite internal lubrication, the damage to the insulating layer of the raw material powder can be effectively suppressed even when the usage amount of the raw material-use lubricant is reduced. Accordingly, by using the powder mold product obtained by the molding method of the present invention, the powder magnetic core with small iron loss can be obtained.

[Molding Procedure]

Next, with reference to FIG. 1, a description will be given of the molding procedure of the molding method of the present invention. The molding procedure includes a preparing step of preparing the raw material powder, an applying step of applying a mold assembly-use lubricant to the inner circumferential face 10*s* of the die 10 by circulative supplying the mold assembly-use lubricant, and a molding step of molding a powder mold product by pressing the raw material powder.

(Preparing Step)

Firstly, raw material powder to be molded is prepared. Specifically, soft magnetic powder is prepared. On the surface of the particles forming the powder, an insulating layer is formed, for example by an insulating material having lubricity. Thus, coated soft magnetic powder being an aggregate of coated particles each having the insulating layer is prepared. Here, when the mixture internal lubrication is employed, powder of a solid lubricant (the raw material-use lubricant) of a desired composition is prepared. This raw material-use lubricant is mixed with the coated soft magnetic powder, to obtain the raw material powder. For this mixing operation, mixing means such as a V-shape rotating mixer, a vibration ball mill, a planetary ball mill and the like can be used.

Further, a mold assembly-use lubricant is prepared. Specifically, powder of a solid lubricant (whose maximum particle size is preferably 20 μm or less) and a non-flammable liquid medium are prepared. Then, a dispersed agent in which the powder of this solid lubricant is dispersed in the liquid medium is fabricated. In order to enhance dispersion, an appropriate dispersion aid agent can be used.

(Applying Step)

Firstly, as shown in FIG. 1(A), in the state where the die 10, the upper punch 11, and the lower punch 12 are separated from one another, a tank packing the fabricated dispersed agent is connected to the supply flow passage 120*i* (see FIG. 2(A)) of the lower punch 12, to be capable of discharging the mold assembly-use lubricant from the supply port 12*i* of the lower punch 12.

Next, as shown in FIG. 1(B), the die 10 is shifted toward the lower side in the drawing, such that one face of the die 10 and the top face 12*u* of the lower punch 12 are substantially flush to each other. Finally, the substantially entire inner circumferential face 10*s* of the die 10 is disposed to oppose to the outer circumferential face 12*s* of the lower punch 12. Between the inner circumferential face 10*s* of the die 10 and the outer circumferential face 12*s* of the lower punch 12, a clearance whose dimension is varied corresponding to the outer shape of the lower punch 12 is formed.

Next, as shown in FIG. 1(C), the die 10 is shifted upward, to form a cavity surrounded by the top face 12*u* of the lower punch 12 and the inner circumferential face 10*s* of the die 10. During the upward shifting of the die 10, the circulative supply of the mold assembly-use lubricant is performed, in which the mold assembly-use lubricant is discharged from the supply port 12*i*, and the surplus of the discharged mold assembly-use lubricant is drained from the drain port 12*o*. More specifically, the mold assembly-use lubricant discharged from the supply port 12*i* is sent toward the drain port 12*o* along the space surrounded by the inner circumferential face of the circulative groove 12*g* and the inner circumferential face 10*s* of the die 10. At this time, since the die 10 and the lower punch 12 are relatively shifted, the mold assembly-use lubricant in the circulative groove 12*g* is applied to the inner circumferential face 10*s* of the die 10. Furthermore, since the surplus of the mold assembly-use lubricant sent to the circulative groove 12*g* is collected from the drain port 12*o*, the mold assembly-use lubricant will not be applied to the inner circumferential face 10*s* of the die 10 more than necessary.

At the time point of FIG. 1(C), the mold assembly-use lubricant is uniformly applied over the entire circumference of the inner circumferential face 10*s* of the die 10 forming the cavity. Further, the mold assembly-use lubricant is uniformly applied in the depth direction of the cavity. Thus, a lubricant layer 2 of a uniform thickness is formed. Note that, for the sake of convenience, the particles of the solid lubricant of the lubricant layer 2 are shown in an exaggerated manner in FIGS. 1 and 2.

Here, when the liquid medium of the mold assembly-use lubricant is a substance that relatively takes time to vaporize, such as water, the liquid medium can be removed by vaporization by the mold assembly being appropriately heated (preferably 50° C. or more and less than 100° C.). With the liquid medium is of high volatility, the mold assembly may not be heated, or the heating temperature may be reduced. It is also possible to supply dry air at room temperatures (representatively, about 20° C.) into the cavity, such that the vapor in the cavity can be more surely released to the outside.

(Molding Step)

As shown in FIG. 1(D), the prepared raw material powder 3 is supplied into the cavity provided with the lubricant layer 2, using a not-shown powder feeding apparatus. Then, as shown in FIG. 1(E), the upper punch 11 is shifted downward to be pushed into the through hole 10*h* of the die 10. Thus, the raw material powder 3 is pressed by the punches 11 and 12. At this time, by the lubricant layer 2 (the particles of the solid lubricant forming the mold assembly-use lubricant), the friction between the raw material powder 3 and the inner circumferential face 10*s* of the die 10 can be reduced. Here, when the raw material powder 3 is caused to contain a raw material-use lubricant, or the insulating layer is provided with lubricity, the friction between the raw material powder and the punches 11 and 12 and the friction among the coated particles of the raw material powder 3 can be reduced. Thus, the raw material powder 3 can be compressed in an excellent manner.

The molding pressure may be 390 MPa or more and 1500 MPa or less. The molding pressure of 390 MPa or more makes it possible to fully compress the raw material powder 3 (the coated particles), and the relative density of the powder mold product can be increased. The molding pressure of 1500 MPa or less makes it possible to suppress any damage to the insulating layer caused by contact among the coated particles in the raw material powder 3. More preferably, the molding pressure is 700 MPa or more and 1300 MPa or less.

When prescribed pressing has performed, as shown in FIG. 1(F), the upper punch 11 is shifted upward and the die 10 is shifted downward. Thus, a powder mold product 100 is taken out. At this time, thanks to the mold assembly-use lubricant applied to the inner circumferential face 10*s* of the die 10, friction between the powder mold product 100 and the inner circumferential face 10*s* of the die 10 is reduced. Thus, the powder mold product 100 can be easily taken out. From the foregoing procedure, the powder mold product 100 can be obtained. Note that, the order of shifting the upper punch 11 and the die 10 is not limited, and they may be shifted simultaneously.

When the powder mold product 100 is taken out from the state shown in FIG. 1(F), the die 10 and the punches 11 and 12 are disposed in the state shown in FIG. 1(B). Accordingly, when molding is to be successively performed, the procedure in FIGS. 1(C) to 1(F) should be repetitively performed.

In the case where a magnetic core is fabricated with the powder mold product obtained by the foregoing procedure, hysteresis loss can be reduced by subjecting the powder mold product to heat treatment to thereby remove strain that has occurred during molding. The higher the temperature of heat treatment, the greater a reduction in hysteresis loss. However, an excessively high temperature may invite pyrolysis of the constituent material of the insulating layer. Accordingly, the temperature is selected in the range under the pyrolysis temperature of the constituent material of the insulating layer. Representatively, the heating temperature may be 400° C. to 700° C., and the holding time may be 30 minutes or more and 60 minutes or less. When the insulating layer is made of amorphous phosphate such as iron phosphate or zinc phosphate, the heating temperature is preferably up to about 500° C. When the insulating layer is made of an insulating material that exhibits excellent heat resistance, such as metal oxide or silicone resin, the heating temperature is raised to 550° C. or more, further to 600° C. or more, and particularly to 650° C. or more. The heating temperature and the holding time can be selected as appropriate in accordance with the constituent material of the insulating layer.

[Effect]

According to the molding method of the present invention having the above-described structure, friction between the powder mold product 100 and the mold assembly 1 (the inner circumferential face 10*s* of the die 10) can be effectively suppressed. Accordingly, it becomes possible to effectively prevent the insulating layer of the particles forming the powder mold product 1 from being damaged by such friction at the outer circumferential face of the powder mold product 1. As a result, a powder mold product with small loss can be obtained. In the case where a powder magnetic core is fabricated by subjecting the obtained powder mold product to heat treatment, the obtained powder magnetic core involves effectively reduced eddy-current loss, and small iron loss. That is, the molding method of the present invention can provide a powder mold product with which a powder magnetic core with small iron loss can be obtained.

Further, in the molding method of the present invention, since the mold assembly-use lubricant is applied to the inner circumferential face 10*s* of the die 10 by circulative supply, unnecessary mold assembly-use lubricant is less likely to remain in the cavity of the mold assembly 1. Furthermore, since unnecessary raw material powder can be collected together with the mold assembly-use lubricant, the raw material powder will not be accumulated in the mold assembly 1 or clog the supply port 12*i*. Therefore, even when a plurality of powder mold products are successively fabricated, sound molding of the powder mold product can be maintained for a multitude of times.

Second Embodiment

Figure 3:
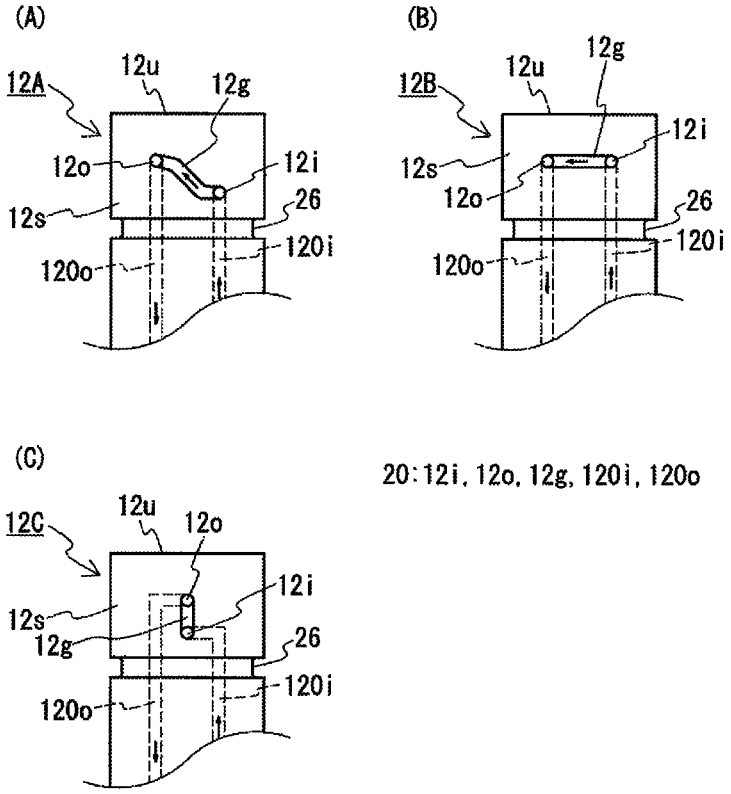
FIGS. 3(A) to 3(C) are each a partial enlarged diagram of a lower punch of a mold assembly used in a method for molding a powder mold product of the present invention according to a second embodiment.

In a second embodiment, a description will be given of a molding method of the present invention (the partial external lubrication) in which a mold assembly-use lubricant is applied to part of the inner circumferential face of the die. Before proceeding to the description, the mode of a mold assembly used herein will be described with reference to FIGS. 3(A) to (C). Note that, since the structures illustrated in FIG. 3 are identical to one another in that the supply port and the drain port are provided to the lower punch, only the lower punch is shown in FIG. 3.

In a lower punch 12A shown in FIG. 3(A), both the supply port 12*i* and the drain port 12*o* are formed on the face on the near side in the drawing, and the supply port 12*i* and the drain port 12*o* are displaced from each other in both the circumferential direction and the axial direction of the lower punch 12A. Accordingly, the circulative groove 12*g* connecting between the supply port 12*i* and the drain port 12*o* extends diagonally above from the supply port 12*i*, to communicate with the drain port 12*o*.

In a lower punch 12B shown in FIG. 3(B), the supply port 12*i* and the drain port 12*o* are formed at the same position in the axial direction of the lower punch 12B but are displaced from each other in the circumferential direction (i.e., at different positions on the identical circle). Accordingly, the circulative groove 12*g* connecting between the supply port 12*i* and the drain port 12*o* extends in the circumferential direction of the lower punch 12B.

In a lower punch 12C shown in FIG. 3(C), the supply port 12*i* and the drain port 12*o* are formed at the same position in the circumferential direction of the lower punch 12C but are displaced from each other in the axial direction (i.e., at different positions on the identical axial line). Accordingly, the circulative groove 12*g* connecting between the supply port 12*i* and the drain port 12*o* extends in the axial direction of the lower punch 12C.

With any of the lower punches 12A to 12C shown in FIGS. 3(A) to 3(C), the mold assembly-use lubricant can be applied to the inner circumferential face 10*s* so as to divide the inner circumferential face 10*s* of the die 10 shown in FIG. 1 in the circumferential direction. In this manner, by applying the mold assembly-use lubricant uniformly in the depth direction of the cavity dividing the inner circumferential face 10*s* of the die 10 in the circumferential direction, the area where the insulating layer extending substantially in parallel to the pressing direction of the powder mold product in the outer circumferential face of the obtained powder mold product is sound can be formed. In the case where a magnetic core being such a powder mold product is excited in which the pressing direction is the magnetic flux direction, eddy current that flows in the circumferential direction about the magnetic flux direction can be blocked.

Further, with the structures of the present embodiment, the mold assembly-use lubricant can be saved. Furthermore, the structures described above are additionally advantageous in that the structure of the lower punch can be simplified.

<First Variation>

In the embodiments described above, the description has been given of the structures with which a solid powder mold product with no through hole is molded. In other possible mode, the molding method of the present invention can also be applied to molding of a powder mold product with a through hole (representatively, a ring-shaped element). In this case, a mold assembly that includes a die, a lower punch, an upper punch, and a core rod that is disposed relatively shiftable to the lower punch is used. In this mode, both the inner circumferential face of the die and the outer circumferential face of the core rod can serve as the sliding contact face relative to the molded product. Accordingly, the supply port, the drain port, and the circulative groove are provided to the lower punch such that the mold assembly-use lubricant can be applied to both of the inner circumferential face of the die and the outer circumferential face of the core rod. For example, when the lower punch is a tubular element having a through hole into which the core rod is inserted, the supply port, the drain port, and the circulative groove should be provided partially in the circumferential direction to the outer circumferential face and the inner circumferential face of the lower punch, similarly to the embodiments described above.

<Second Variation>

In the embodiments described above, the description has been given of the structure in which the raw material powder 3 is supplied after the cavity is formed. In place of this structure, for example in the state shown in FIG. 1(B), a powder feeding apparatus may be disposed so as to cover the top face 12*u* of the lower punch 12, such that the powder feeding apparatus also is shifted as the die 10 is shifted. In this case, in accordance with the die 10 being shifted upward, a space surrounded by the top face 12*u* of the lower punch 12 and the inner circumferential face 10*s* of the die 10 is created. Into this space, the raw material powder 3 is successively supplied from the powder feeding apparatus. Further, by the die 10 being shifted upward, the mold assembly-use lubricant is applied to the inner circumferential face 10*s* of the die 10. That is, with this structure, the shifting of the die 10 simultaneously achieves application of the mold assembly-use lubricant and supply of the raw material powder 3 into the space having the lubricant applied to its surrounding. As shown in FIG. 1(D), when the space defined by the top face 12*u* of the lower punch 12 and the inner circumferential face 10*s* of the die 10 becomes a prescribed size, the powder feeding apparatus should be shifted such that pressing with the upper punch 11 can be performed.

Test Example 1

Powder mold products were fabricated using various types of powder and molding method. The obtained powder mold products were subjected to heat treatment, to fabricate powder magnetic cores. Then, the loss with magnetic components having the obtained powder magnetic cores was examined.

(Sample No. 1: Mixture Internal Lubrication+Entire External Lubrication)

In connection with Sample No. 1, with a powder mixture of coated soft magnetic metal powder provided with an insulating layer and powder made of a solid lubricant, and the mold assembly 1 shown in FIG. 1 (the lower punch 12 including the circulative supply mechanism 20), the mold assembly-use lubricant was applied along the entire circumference of the inner circumferential face 10*s* of the die 10. Thereafter, molding was performed, to obtain the powder mold product 100.

In the present test, as the soft magnetic metal powder, pure iron powder (average particle size d: 50 μm) manufactured by water atomization was prepared. Subsequently, the pure iron powder was subjected to chemical conversion coating. Thus, by forming an inner film (having a thickness of about 20 nm or less) made of a metal phosphate compound, coated soft magnetic powder having an insulating layer of the single-layer structure was fabricated. The coated soft magnetic powder formed by the coated particles each provided with the insulating layer was mixed with zinc stearate powder as the raw material-use lubricant. The mixing amount of the raw material-use lubricant was adjusted to 0.6 mass percent, relative to the powder mixture of the coated soft magnetic powder and the raw material-use lubricant powder being 100 mass percent.

As the solid lubricant, the powder of ethylene bis stearamide (EBS) whose maximum particle size was 18.5 μm and average particle size was 4.2 μm was prepared. This powder was dispersed in a liquid medium (water in the present test) to fabricate a dispersed agent, which was used as the mold assembly-use lubricant. The mixing amount of this solid lubricant was adjusted to 45 mass percent, relative to the dispersed agent being 100 mass percent. The mold assembly-use lubricant was applied by 0.0018 g/cm$^2$.

Then, with Sample No. 1, in molding the powder mold product, the mold assembly-use lubricant was applied to the entire circumference of the inner circumferential face 10*s* of the die 10 by the relative shifting of the lower punch 12 and the die 10 as described above (here, the mold assembly-use lubricant was supplied by 2.5 mL/min). Thereafter, the mold assembly was heated to 60° C. such that the liquid medium was fully vaporized and removed. Then, the powder mixture was packed into the cavity and pressed at the molding pressure of 730 MPa. Thus, the rectangular parallelepiped-shaped powder mold product 100 was obtained. This molding procedure including application of the mold assembly-use lubricant to the mold assembly 1 and molding under pressure was successively performed for 1001 times (shots).

(Sample No. 2: Coat Internal Lubrication+Entire External Lubrication)

In connection with Sample No. 2, coated soft magnetic powder in which pure iron powder identical to Sample No. 1 was provided with an insulating layer of a multilayer structure was prepared. The insulating layer was formed as follows. The pure iron powder was subjected to chemical conversion coating, to form an inner film (having a thickness of about 20 nm or less) made of a metal phosphate compound containing water of hydration. The particles having the inner film and a commercially available resin material (silicone XC96-B0446 available from Momentive Performance Materials Inc. (a substance that becomes silicone resin by a hydrolysis condensation polymerization reaction) were mixed in heating atmosphere (80° C. to 150° C.), to form the insulating layer of a multilayer structure including the inner film made of a metal phosphate compound and an outer layer (having a thickness of about 1 μm or less) made of silicone resin. Then, under the same condition as Sample No. 1, the mold assembly-use lubricant was applied to the entire surface of the inner circumferential face 10*s* of the die 10. Thereafter, under the similar condition as Sample No. 1, the powder mold product 100 of the similar size and shape was fabricated. The procedure was performed for 1001 times (shots) as to Sample No. 2 also.

(Test for Each Sample)

Measuring members (corresponding to magnetic components) for measuring iron loss were fabricated using the powder mold products obtained by the 100 shots for each sample. The measuring member was fabricated as follows. Firstly, the obtained powder mold products were subjected to heat treatment, to obtain heat-treated members from which pressure strain associated with the pure iron powder contained in the powder mold products was removed. The condition of heat treatment was as follows. As to Sample No. 1, 400° C.×30 minutes in nitrogen atmosphere; and as to Sample No. 2, 550° C.×30 minutes in nitrogen atmosphere. Then, the heat-treated members were annularly combined, to fabricate a test-purpose magnetic core. The measuring member was fabricated by disposing a coil formed by a wire to the test-purpose magnetic core (the specification is common to both of the samples).

For each measuring member, employing the pressing direction in the molding procedure as the magnetic flux direction, hysteresis loss Wh1/5 k (W/kg) and eddy-current loss We1/5 k (W/kg) with the magnetic flux density in an excited state Bm of 1 kG (=0.1 T) and the measurement frequency of 5 kHz were measured using an AC-BH curve tracer, and iron loss W1/5 k (W/kg) was calculated from hysteresis loss+eddy-current loss. The result is shown in Tables 1 and 2.

TABLE 1

Test Result of Sample No. 1*

| Number of Shot | Iron Loss W1/5k (W/kg) | Hysteresis Loss Wh1/5k (W/kg) | Eddy-Current Loss We1/5k (Ws/kg) |
|---|---|---|---|
| 1 | 11.2 | 10.8 | 0.4 |
| 101 | 11.0 | 10.6 | 0.4 |
| 201 | 11.2 | 10.8 | 0.4 |
| 301 | 10.8 | 10.4 | 0.4 |
| 401 | 10.8 | 10.4 | 0.4 |
| 501 | 10.8 | 10.5 | 0.3 |
| 601 | 10.8 | 10.7 | 0.1 |
| 701 | 10.9 | 10.7 | 0.2 |
| 801 | 10.9 | 10.7 | 0.2 |
| 901 | 10.8 | 10.5 | 0.3 |
| 1001 | 10.9 | 10.8 | 0.1 |

*Mixture Internal Lubrication + Entire External Lubrication

TABLE 2

Test Result of Sample No. 2*

| Number of Shot | Iron Loss W1/5k (W/kg) | Hysteresis Loss Wh1/5k (W/kg) | Eddy-Current Loss We1/5k (Ws/kg) |
|---|---|---|---|
| 1 | 9.5 | 9.0 | 0.5 |
| 101 | 9.3 | 8.7 | 0.6 |
| 201 | 9.4 | 8.7 | 0.7 |
| 301 | 9.3 | 8.6 | 0.7 |
| 401 | 9.3 | 8.5 | 0.8 |
| 501 | 9.8 | 9.6 | 0.2 |
| 601 | 9.6 | 8.7 | 0.9 |
| 701 | 9.5 | 8.7 | 0.8 |
| 801 | 9.7 | 8.6 | 1.1 |
| 901 | 9.8 | 8.7 | 1.1 |
| 1001 | 9.7 | 8.6 | 1.1 |

*Coat Internal Lubrication + Entire External Lubrication

As shown in Tables 1 and 2, with Sample Nos. 1 and 2, even when molding under pressure were successively performed for over 1000 shots, the iron loss of the obtained powder mold products did not extremely increase. It may be attributed to the circulative supply, in which: in applying the mold assembly-use lubricant to the entire circumference of the inner circumferential face 10*s* of the die 10 by the relative shifting between the lower punch 12 and the die 10, while the mold assembly-use lubricant is successively supplied from the supply port 12*i* of the lower punch 12, the mold assembly-use lubricant is collected from the drain port 12*o* of the lower punch 12. That is, by performing circulative supply, the mold assembly-use lubricant can be prevented from excessively supplied and applied. Further, the fine raw material powder having passed through the clearance between the die 10 and the lower punch 12 is prevented from accumulating in the mold assembly, and from clogging the supply port. Accordingly, uniform application of the mold assembly-use lubricant to the inner circumferential face 10*s* of the die 10 can be maintained for a multiple of times.

Test Example 2

In Test Example 1, the mold assembly-use lubricant was applied over the entire circumference of the inner circumferential face 10*s* of the die 10. Thereafter, molding was performed to obtain the powder mold product 100. On the other hand, in Test Example 2, the mold assembly-use lubricant was applied to only part of the inner circumferential face 10*s* of the die 10 to fabricate a powder mold product. The obtained powder mold product was subjected to heat treatment, to fabricate a powder magnetic core. Then, the loss with the magnetic component having the obtained powder magnetic core was examined.

(Mixture Internal Lubrication+Partial External Lubrication)

Using the lower punch 12B shown in FIG. 3(B), the mold assembly-use lubricant was applied to only part of the inner circumferential face 10*s* of the die 10. Except for this point, a powder magnetic core was fabricated under the molding condition and the heat treatment condition identical to those of Sample No. 1 of Test Example 1. Then, iron loss W1/5 k (W/kg), hysteresis loss Wh1/5 k (W/kg), and eddy-current loss We1/5 k (W/kg) were obtained under the condition identical to that of Sample No. 1. Further, for the purpose of comparison, the iron loss, hysteresis loss, and eddy-current loss of a powder magnetic core that was fabricated without application of the mold assembly-use lubricant to the inner circumferential face 10*s* of the die 10 were obtained. The result is shown in Table 3. Note that the number of shot is "1".

TABLE 3

Number of Shot = 1

| Sample | Iron Loss W1/5k (W/kg) | Hysteresis Loss Wh1/5k (W/kg) | Eddy-Current Loss We1/5k (Ws/kg) |
|---|---|---|---|
| Mixture Internal Lubrication + Partial External Lubrication | 11.4 | 10.8 | 0.6 |
| No Application | 29.1 | 12.7 | 16.4 |

(Coat Internal Lubrication + Partial External Lubrication)

Using the lower punch 12B shown in FIG. 3(B), the mold assembly-use lubricant was applied to only part of the inner circumferential face 10*s* of the die 10. Except for this point, a powder magnetic core was fabricated under the molding condition and the heat treatment condition identical to those of Sample No. 2 of Test Example 1. Then, iron loss W1/5 k (W/kg), hysteresis loss Wh1/5 k (W/kg), and eddy-current loss We1/5 k (W/kg) were obtained under the condition identical to that of Sample No. 2. Further, for the purpose of comparison, the iron loss, hysteresis loss, and eddy-current loss of a powder magnetic core that was fabricated without application of the mold assembly-use lubricant to the inner circumferential face 10*s* of the die 10 were obtained. The result is shown in Table 4. Note that the number of shot is "1".

TABLE 4

| Number of Shot = 1 | | | |
|---|---|---|---|
| Sample | Iron Loss W1/5k (W/kg) | Hysteresis Loss Wh1/5k (W/kg) | Eddy-Current Loss We1/5k (Ws/kg) |
| Coat Internal Lubrication + Partial External Lubrication | 9.4 | 8.7 | 0.7 |
| No Application | 24.5 | 9.5 | 15 |

From the results shown in Tables 3 and 4, it is found that, even in the case where the mold assembly-use lubricant is applied to just part of the inner circumferential face 10*s* of the die 10, the iron loss can be drastically reduced as compared to the case where no mold assembly-use lubricant is applied to the inner circumferential face 10*s*. Further, it is found that, by comparing the results shown in Tables 3 and 4 and the result of the first shot shown in Tables 1 and 2, the partial external lubrication can provide a powder magnetic core that has a magnetic characteristic being comparable to that obtained by the entire external lubrication. Here, the measurement result of Test Example 2 was obtained by the structure in which circulative supply of the mold assembly-use lubricant was performed, similarly to Test Example 1. Therefore, it is considered that, even when the number of shot is increased in Test Example 2, powder magnetic cores maintaining the magnetic characteristic that is comparable to the first shot can be obtained.

Note that, the present invention is not limited to the embodiments and variations described above, and changes can be made as appropriate within the range not departing from the gist of the present invention. For example, the material and size of the soft magnetic metal particles, the material and thickness of the insulating layer, the material, size, applied area of the solid lubricant in the mold assembly-use lubricant, the material of the liquid medium, the proportion of the solid lubricant relative to the liquid medium, the material and content of the raw material-use lubricant, the shape of the cavity formed by the punches and the die, the shape of the punches and the like can be changed as appropriate. Furthermore, the method for molding a powder mold product of the present invention can be used for molding a simple powder mold product not being a powder magnetic core.

INDUSTRIAL APPLICABILITY

The method for molding a powder mold product of the present invention can be preferably used for manufacturing a powder magnetic core, particularly a powder mold product being suitable as the material of a powder magnetic core with an excellent high frequency characteristic.

REFERENCE SIGNS LIST

1: MOLD ASSEMBLY
10: DIE
10*h*: THROUGH HOLE
10*s*: INNER CIRCUMFERENTIAL FACE OF DIE
11: UPPER PUNCH
12, 12A, 12B, 12C: LOWER PUNCH
12*s*: OUTER CIRCUMFERENTIAL FACE OF LOWER PUNCH
12*u*: TOP FACE OF LOWER PUNCH
20: CIRCULATIVE SUPPLY MECHANISM
12*i*: SUPPLY PORT
120*i*: SUPPLY FLOW PASSAGE
12*o*: DRAIN PORT
120*o*: DRAIN FLOW PASSAGE
12*g*: CIRCULATIVE GROOVE
26: SEALING GROOVE
2: LUBRICANT LAYER
3: RAW MATERIAL POWDER
100: POWDER MOLD PRODUCT

The invention claimed is:

1. A method for molding a powder mold product, in which raw material powder is packed into a cavity formed by a first punch and a die capable of being relatively shifted, a powder mold product being molded by the raw material powder in the cavity being pressed by the first punch and a second punch, the method comprising:

a preparing step of preparing the raw material powder;

an applying step of interposing a mold assembly-use lubricant between an outer circumferential face of the first punch and an inner circumferential face of the die, the first punch and the die in this state being relatively shifted to apply the mold assembly-use lubricant to the inner circumferential face of the die; and a molding step of packing the raw material powder into the cavity surrounded by the first punch and the die to which the mold assembly-use lubricant has been applied, a powder mold product being molded by the raw material powder being pressed by the first punch and the second punch, wherein in the applying step, while the mold assembly-use lubricant is discharged from a supply port provided to the first punch and the discharged mold assembly-use lubricant is collected from a drain port provided to the first punch, the mold assembly-use lubricant is applied to the inner circumferential face of the die.

2. The method for molding a powder mold product according to claim 1, wherein in the applying step, the mold assembly-use lubricant is applied to the entire inner circumferential face of the die.

3. The method for molding a powder mold product according to claim 1, wherein in the applying step, the mold assembly-use lubricant is applied to part of the inner circumferential face of the die.

4. The method for molding a powder mold product according to claim 1, wherein in the preparing step, the raw material powder being mixed with a raw material-use lubricant made of a solid lubricant is prepared.

5. The method for molding a powder mold product according to claim 1, wherein the mold assembly-use lubricant is a dispersed agent in which particles made of a solid lubricant are dispersed in a non-flammable liquid medium.

6. The method for molding a powder mold product according to claim 5, wherein the solid lubricant in the mold assembly-use lubricant includes ethylene bis stearamide.

7. The method for molding a powder mold product according to claim 1, wherein the raw material powder contains coated soft magnetic powder that is an aggregate of soft magnetic metal particles each provided with an insulating layer.

* * * * *